United States Patent [19]

Blume et al.

[11] 4,181,420

[45] Jan. 1, 1980

[54] DEVELOPMENT DEVICE FOR DEVELOPING SHEETS OF DIAZO COPYING MATERIAL

[75] Inventors: Erich Blume, Wiesbaden; Eberhard Schornig, Taunusstein, both of Fed. Rep. of Germany

[73] Assignee: Hoechst Aktiengesellschaft, Fed. Rep. of Germany

[21] Appl. No.: 865,438

[22] Filed: Dec. 29, 1977

[30] Foreign Application Priority Data

Dec. 30, 1976 [DE] Fed. Rep. of Germany ..... 2659486

[51] Int. Cl.[2] ..... G03D 7/00

[52] U.S. Cl. ..... 354/299; 354/300; 354/319; 34/31; 34/155; 355/27

[58] Field of Search ..... 354/299, 300, 319; 34/31, 152, 155, 162, 234, 236; 432/59; 355/27; 271/84, 85, 194, 268

[56] References Cited

U.S. PATENT DOCUMENTS

| | | | |
|---|---|---|---|
| Re. 26,525 | 2/1969 | Wilde et al. | 354/300 |
| 2,515,144 | 7/1950 | Trump et al. | 34/162 |
| 3,012,492 | 12/1961 | Goodman et al. | 354/300 |
| 3,145,637 | 8/1964 | Frantz | 34/162 |
| 3,552,743 | 1/1971 | Baboz | 271/268 |
| 3,614,088 | 10/1971 | Watson | 271/84 |
| 3,776,117 | 12/1973 | Kobayashi | 354/300 |
| 3,800,432 | 4/1974 | Miyata et al. | 34/155 |
| 4,062,031 | 12/1977 | Schroter | 34/155 |

FOREIGN PATENT DOCUMENTS

| | | | |
|---|---|---|---|
| 2534352 | 3/1977 | Fed. Rep. of Germany | 354/300 |

*Primary Examiner*—L. T. Hix
*Assistant Examiner*—Alan Mathews
*Attorney, Agent, or Firm*—James E. Bryan

[57] ABSTRACT

This invention relates to a development device for developing sheets of diazo copying material, in particular microfiches, comprising a substantially gas-tight, closed development chamber adapted to contain a developer medium composed of ammonia gas and water vapor, a pair of feed rolls at a feed opening, a pair of delivery rolls at a delivery opening and a first and a second pair of guide rolls in said chamber next to the pair of feed rolls and the pair of delivery rolls, an upper and a lower gas-permeable endless belt guided around one roll of each pair of guide rolls in each case, a space between adjacent sides of said endless belts aligned with gaps between the pairs of feed and delivery rolls, and means for presetting the peripheral speed of the feed rolls independently of the development temperature, whereby the sheets may be transported at a relatively high or a relatively low development temperature.

5 Claims, 8 Drawing Figures

DEVELOPMENT DEVICE FOR DEVELOPING SHEETS OF DIAZO COPYING MATERIAL

Figure 1:
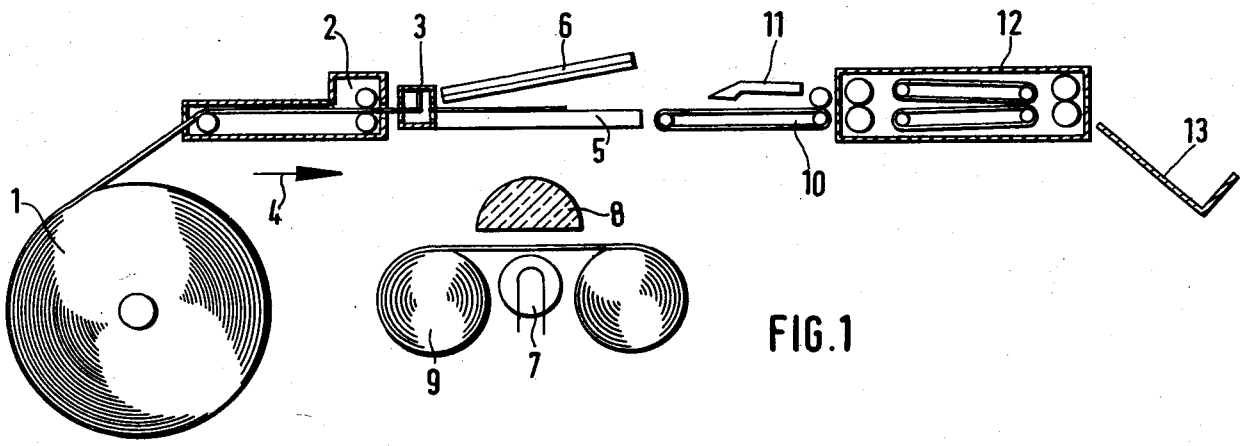

The invention relates to a development device for developing sheets of diazo copying material.

For developing sheets of diazo copying material, the so-called dry-development process is customarily used, in which the sheets of diazo copying material are exposed to a developer medium containing ammonia gas and water vapor. For example, for carrying out such a known process aqueous ammonia, which has been fed into a development chamber, is vaporized by a heated vaporizer. In this process temperatures of about 80° C. prevail in the development chamber. Sheets of diazo copying material on virtually all known carriers, for example carriers based on cellulose, and carriers based on polyester, can be developed, according to this process. Development proceeds, however, relatively slowly. Moreover, precipitation can occur in the development chamber, especially in the vicinity of the guide elements for the diazotype material because the developer medium, containing ammonia gas and water vapor, is, as regards vapor pressure, in a state of saturation. The undesired consequence can be undesired stains on the developed diazotype material as a result of liquid take-up in the vicinity of the guide elements located in the transport path. In addition, the diazotype material takes up substantial amounts of condensed developer medium, above all when the carrier is based on cellulose and/or cellulose pulp.

A particularly advantageous variant of this dry development process has been proposed (German Application No. P 25 34 352.6), having the features that an ammonia-water vapor mixture which is unsaturated in respect of vapor pressure and contains a maximum of 25% by weight of ammonia, is heated in the development chamber to a temperature of between about 105° and 120° C. at a predetermined pressure, preferably atmospheric pressure, and that for replenishment ammonia and/or water is fed into the development chamber, in accordance with the pressure. Surprisingly, no stains have been encountered on the exposed image positions even at temperatures above about 105° C. and up to 120° C. The development process of the present particularly advantageous variant permits, accordingly, a raising of the speed of development while giving good quality in the developed diazotype material. There is therefore the choice whether, with a given transport speed of the diazotype material to be developed, to construct the development chamber to be relatively short, or whether, with a given length of the development chamber, to increase the transport speed of the diazotype material through the development chamber. Apart from this, it is a characteristic of this variant of the process that the developed diazotype material takes up relatively little developer medium, in particular ammonia. Accordingly, the pollution of the environment caused by diazotype material developed in this manner is especially slight. On the other hand, this advantageous variant of the dry development process cannot be used with all carriers of diazotype material, and in particular cannot be used for carriers based on cellulose and/or cellulose pulp.

The object on which the present invention is now based is to provide a development device of the type mentioned at the outset in which sheets of diazo copying material, in particular microfiches, can be developed as desired according to either of the above-mentioned variants of the dry development process. Thus this development device should make it possible to develop diazo copying material as completely as possible at a relatively high development temperature, about 105° C. to 120° C., or at a relatively low development temperature of about 80° C. This device is to be distinguished by a construction expenditure which is as low as possible, should operate reliably and should leave the diazo copying material, as far as possible, undamaged.

For the achievement of this object use is made, inter alia, of a development chamber provided exclusively for developing diazo copying material with a developer medium which is produced by a vaporizer into which aqueous ammonia flows. The diazo copying material is transported in the development chamber at a uniform and constant speed. For this purpose all the pairs of guide rolls, which guide the endless belts, are connected by cogs to a chain drive, which also engages in cogs on a pair of feed rolls and on the pair of delivery rolls. By this means all rolls are driven synchronously. Each of the two endless belts is composed of several endless spiral cords which are guided in grooves of the guide rolls. In this case, the endless cords are so arranged that the endless cords of the one endless belt are not located immediately opposite those of the other endless belt, but that the endless cords of the two pairs are offset relative to each other in the transport plane of the copying material. The endless belts are in this case arranged so closely adjacent to each other, however, that the sheets of diazo copying material are collected reliably by friction between the adjacent sides of the endless belts, so that the sheets of diazo copying material are drawn upwards against the force of gravity even in a vertical arrangement of the developer chamber. In this process the sheets of diazo copying material lie in the shape of a wave between the endless cords of the adjacent sides of the belts.

On the other hand, the developer chamber, according to the present invention, is designed for developing diazo copying material, as desired, at a higher development temperature or at a lower development temperature of the developer medium. In this case only the peripheral speed of the pair of feed rolls and possibly of the pair of delivery rolls is given independently of the specified value of the development temperature. At a higher development temperature, the circulation speed of the endless belts is set at a circulation speed equal to the peripheral speed of the pair of feed rolls, and at a lower development temperature is reset to a speed lower than the peripheral speed of the pair of feed rolls. It is further essential in the context of the invention that the horizontally aligned endless belts be spaced vertically in such a way that a completely free space is formed, between the adjacent sides of the endless belts, in the transport plane between the gaps of the pair of feed rolls and the pair of delivery rolls. In this way it is possible to arrange for the sheets of diazo copying material to be fed into the developer chamber at a speed which is equal to the transport speed in the preceding stations of the copying equipment, in particular in the exposure station and in the transport device placed between the exposure station and the developer chamber. However, the sheets of diazo copying material pass through the development chamber at this above-mentioned speed only when the temperature of the developer medium in the developer chamber is set relatively high. The length of the developer chamber is in this case so dimensioned that, at this throughput speed, the sheets of diazo copying material are very well developed. The developed sheets of diazo copying material then can be delivered at the same speed. This speed setting is always therefore to be recommended when the diazo copying material may be subjected to a relatively high temperature without impairment, in particular staining. This applies in particular to a carrier, for diazo copying material, made of polyester, on which carrier the diazo components are located in a layer of lacquer. If a different diazo copying material is employed, in particular on a carrier containing cellulose or cellulose pulp, the same development chamber also can be retained for developing this material. By this means the expenditure that would be necessary for a second developer chamber and a deflection of the transport line from the one to the other developer chamber does not arise. At a lower development temperature, it is necessary to reduce the circulation speed of the endless belts, while the peripheral speed of at least the pair of feed rolls is appropriately maintained. In this case also no blockage of the sheets of copying material occurs in front of the pair of feed rolls, because the sheets are transported with spacing to the pair of feed rolls. The sheet of diazo copying material conveyed into the development chamber and lying on the lower endless belt is virtually freely movable because it is not clamped between the lower and the upper endless belt. The upper endless belt serves merely for guiding so that the sheet of diazo copying material cannot curve upwards without any restraint. By this means it is ensured that the developed sheet of diazo copying material is guided safely and reliably into the gap of the pair of delivery rolls. As soon as the sheet of diazo copying material has left the pair of feed rolls and is lying completely on the lower endless belt it is transported at a speed corresponding to the circulation speed of the endless belt, which speed is lower than the transport speed in the vicinity of the pair of feed rolls. The sheet of diazo copying material thus passes through the interior of the development chamber in a relatively long period of time and is completely developed therein, in spite of the lower temperature of the developer medium which contains ammonia gas and water vapor. The precondition for this proper functioning is the essential stipulation with regard to dimensioning that the distance between the pair of feed rolls and the pair of delivery rolls must be greater than the length of the sheet of diazo copying material to be developed. The above function is carried out reliably, and without appreciable additional expense, by the development device according to the present invention. Particularly noteworthy in this process is the careful handling of the sheets of diazo copying material, which are in no way jammed or cut about by the endless belts. Endless belts which can be used for this purpose are appropriately glass or silicone fabric belts, wire fabric belts or non-woven materials which are permeable to gas. This development device is also inexpensive because in its application a control system for the transport speed of the entire copying equipment, into which the development device is arranged on-line, can be dispensed with. Such a control system is not only expensive but in certain circumstances cannot be reasonably effected if, for example, a shutter in the exposure station and/or a cutting device for the diazo copying material are driven by the same drive motor which drives the rolls of the development chamber.

The development device according to the invention has as a starting point the fact that the sheets of diazo copying material are transported into the development chamber with a given minimum spacing, as is customary with a known microfiche duplicating machine with stationary exposure. If the endless belts circulate in the develment chamber at the speed with which the sheets of diazo copying material outside the development chamber are transported, and at which the pairs of feed and delivery rolls are also driven, the spacing between the sheets of diazo copying material in the development chamber does not change. If, on the other hand, the endless belts are driven at a lower speed than that corresponding to the peripheral speed of the pair of feed rolls, and of the pair of delivery rolls, then the spacing between the sheet of diazo copying material located in the development chamber and the sheet of diazo copying material which is to be developed next, and which is still located outside the development chamber, will decrease. A minimum spacing, in the normal transport, is therefore necessary between the successive sheets of diazo copying material which are to be developed, so that these sheets cannot overlap on being fed into the development chamber at a lower circulation speed of the endless belts.

The switching-over of the circulation speed of the endless belts can be effected most simply by means of a pair of cogs which is located between the drive elements, a motor, on the one hand, and the pair of guide rolls, on the other hand, the cogs of this pair of cogs being interchangeable with each other. The pair of cogs can be so dimensioned that with the one configuration of the pair of cogs, the circulation speed of the endless belts is equal to the peripheral speed of the pairs of feed and delivery rolls, and with the other possible configuration of the pair of cogs the desired lower circulation speed of the endless belts is achieved, so that the sheets of diazotype material developed at the lower temperature are completely developed during the passage through the available stretch of the development chamber.

The development device is appropriately so designed that the vertical distance between the endless belts is greater at the side facing the pair of feed rolls than at the side facing the pair of delivery rolls, and that the completely free space between the adjacent sides of the belts is wedge-shaped. By this means it is ensured that the front edge of the sheet of diazo copying material enters in reliably between the two endless belts in the development chamber, and that the front edge is guided, for the delivery of the sheet of diazo copying material, as accurately as possible to the gap between the rolls of the pair of delivery rolls.

For switching-over the circulation speed of the endless belts in the development device it is appropriately provided that at least one pair of guide rolls of the endless belts is connected via a gearbox to a drive motor. With this gearbox the speed of the endless belts can be set easily and rapidly to a higher or a lower value.

A particularly accurate adjustment of the development time and of the transport speed of the diazo copying material in the development chamber, to the different requirements which are set by the type of diazo copying material and the development parameters selected for it, can be obtained when at least one pair of guide rolls of the endless belts is connected via an infinitely variable gearbox to a drive motor. The infinitely variable gearbox is in this case adjusted automatically in accordance with a control device, according to a preset program, until the transport speed within the development chamber has reached the value appropriate for the selected development process.

A variant of the development device has the features that the pair of guide rolls can be connected by means of an electromagnetically operable clutch to the drive motor, and that to preset a standstill time the electromagnetically operable clutch is connected to a timer, the input of the timer being connected to a pulse generator which gives a pulse when each sheet of diazo copying material is fed in to the development chamber. It is preferred in this case that the pulse generator can be switched over in such a manner that in the case of operation, when a relatively high development temperature prevails in the interior of the development chamber, the pulse generator is inactive, so that the endless belts continue to be driven, as are the pairs of feed and delivery rolls. In the case of operation with a relatively low development temperature, on the other hand, the circulation of the endless belts is stopped from time to time for a preset period of time when the sheet of diazo copying material to be developed lies on the lower endless belt. The sheet of diazo copying material then remains, in the development chamber for a standstill time which is sufficiently long so that when the sheet is subsequently transported out of the development chamber it has been very well developed during the total dwell time. The resultant throughput speed of the intermittently transported sheet of copying material is thus varied in this case also as a function of the development temperature. In contrast to the possibility described above, the endless belts are here driven at the same circulation speed for all operating cases and are stopped only for a preset time for the case when a longer dwell of the sheet of diazo copying material in the development chamber is desired. Because the endless belts are permeable to gas, a uniform development of the sheet of diazo copying material is achieved even if the latter does not move in the development chamber and, moreover, the diazo layer side is the support side. This variant can be distinguished by an especially low expenditure.

Advantageously, the development device is equipped in such a way with at least one heating means for heating the development chamber and at least one thermostat with a desired-value setting device for regulating the development temperature, the thermostat being connected to the heating means, that actuating means for the gearbox are coupled to the desired-value setting device of the thermostat. By this means, the setting of the development device is facilitated. Faulty operations are virtually excluded.

For the second variant of the development device, with at least one heating means for heating the development chamber and at least one thermostat with a desired-value setting device for regulating the temperature in the development chamber, the thermostat being connected to the heating means, it is provided, in an appropriate manner, that the timer is set up to give adjustable time intervals (standstill times), and that a setting element of the timer is coupled to the desired-value setting device in order to preset the time intervals. Thus, with the setting element of the timer, the optimum dwell time of the diazo copying material in the development chamber can be preset, for each type of diazo copying material and for all development temperatures which can be set, and can be made effective in the processing of the corresponding diazo copying material and in the setting of the development temperature suitable therefor. Here also the operation can be effected in a simple and largely faultproof manner.

Appropriately, the development device is so equippped that in addition to the peripheral speed of the pair of feed rolls, the peripheral speed of the pair of delivery rolls is also preset independently of the specified value of the development temperature. In this case, the pair of delivery rolls, in the case of the lower circulation speed of the endless belts, takes up the sheet of diazo copying material from the lower endless belt and conveys it out of the development chamber more rapidly than corresponds to the circulation speed of the endless belts. These endless belts are therefore ready to receive the next sheet of copying material particularly rapidly.

When a development device having a development chamber is used in conjunction with an exposure station and, if appropriate, several stations for cutting a sheet of diazo copying material from a supply roll, for transporting the sheet of diazo copying material to the exposure station and for transporting the imagewise exposed sheet to the development chamber, a shared drive motor being provided to drive these stations, the construction cost can be low as a result of at least the one pair of guide rolls being connected to the shared drive motor via the gearbox and/or the clutch. Accordingly, no separate drive motor is required for driving the endless belts.

The development device is furthermore appropriately so designed that the pair of feed rolls, which are driven at an essentially constant speed, is located in the interior of the development chamber. With this arrangement, the pair of feed rolls serves not only to feed the sheet of diazo copying material into the development chamber and between the endless belts but also to preheat the sheet of diazo copying material by the transmission of heat by means of contact so that it is ready for optimum development.

For the desired mode of operation of the development device it is moreover provided that the development chamber is connected to means for feeding the sheets of diazo copying material with preset spacing between the sheets. By these means it is ensured that the sheets of diazo copying material enter after each other into the development chamber with such a spacing that the reduction of the throughput speed of the sheet of diazo copying material through the development chamber is possible without impediments.

This is achieved in particular by a development device with the features that a gripping device is provided as a means for feeding the sheets of diazo copying material with preset spacing, which gripping device is equipped for collecting the sheets of diazo copying material in the exposure station and laying them on a belt conveyor which leads to the pair of feed rolls.

Figure 2:
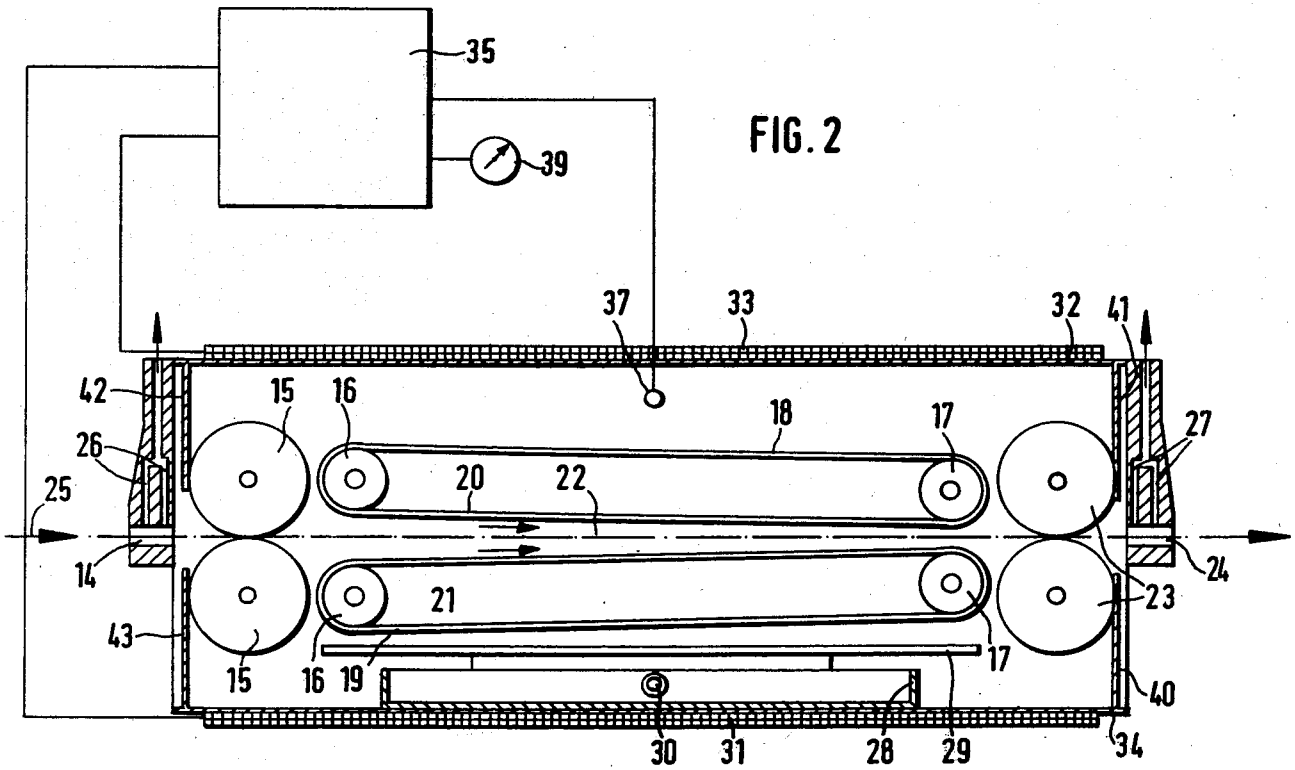
Figure 3:
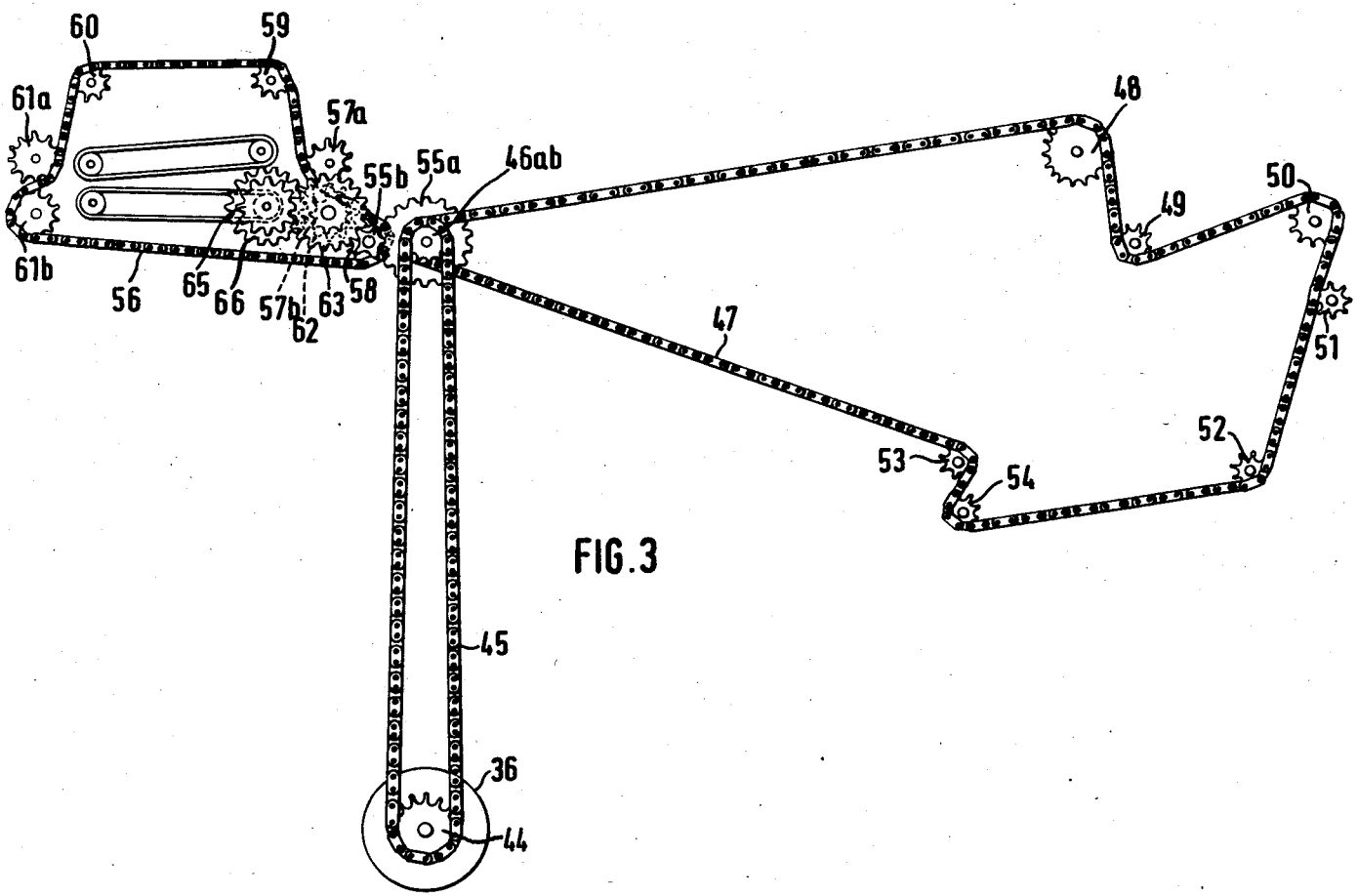
Figure 4:
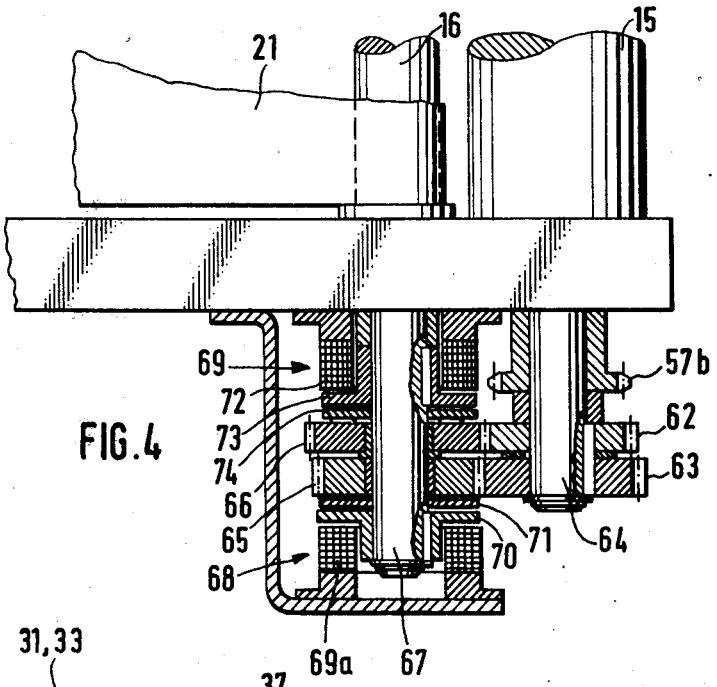
Figure 5:
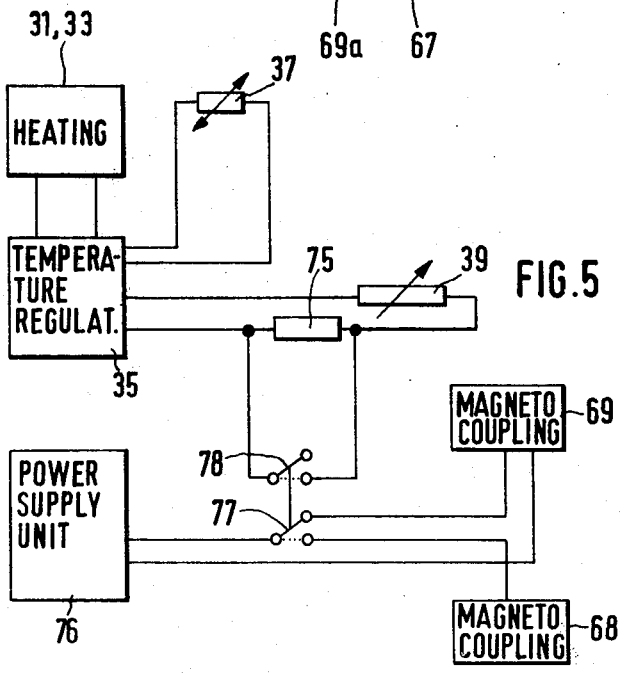
Figure 6:
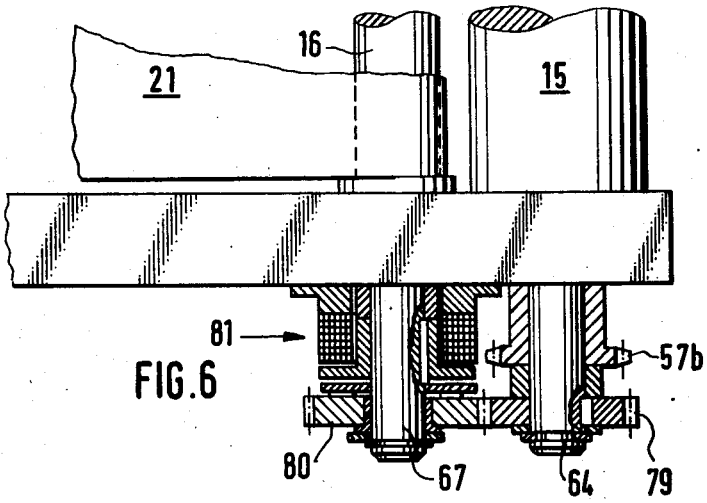
Figure 8:
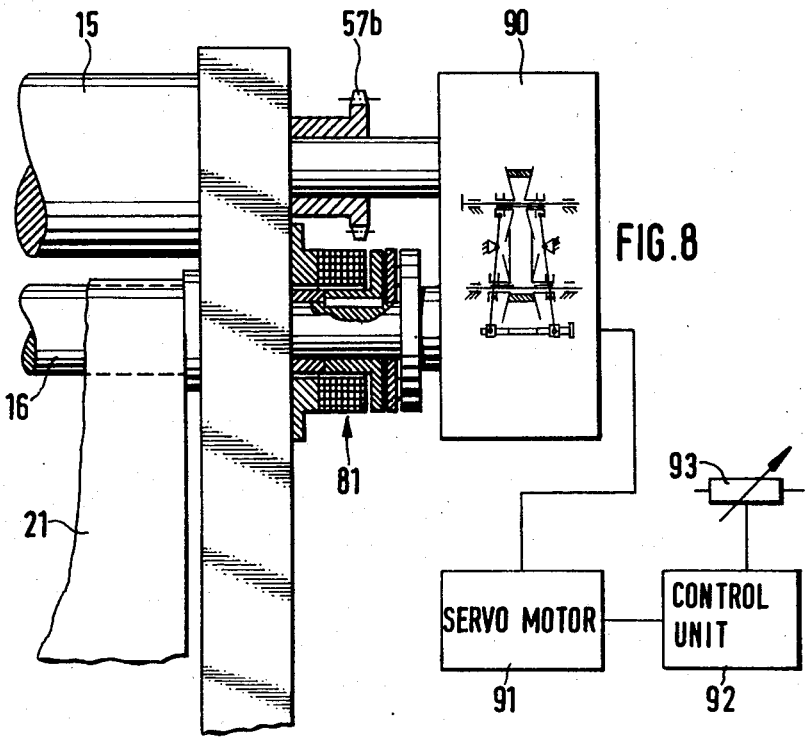
Figure 7:
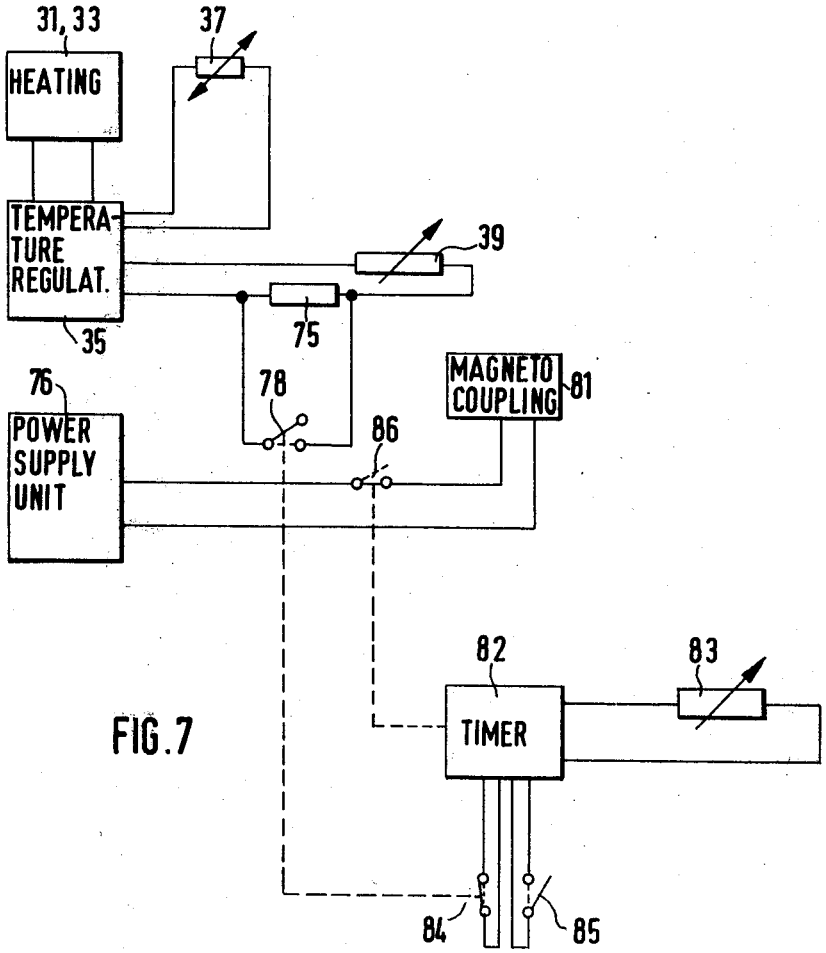

Preferred embodiments of the invention are described below with the aid of the accompanying drawings, in which:

FIG. 1 shows, in a highly simplified longitudinal section, a microfiche duplicating machine with a development chamber, FIG. 2 shows the development chamber in a detailed representation in longitudinal section, FIG. 3 shows the drive side of a microfiche duplicating machine, according to FIG. 1, with drive means drawn schematically, FIG. 4 shows, in a section, a detail of the gearbox elements which are connected to the development chamber of a first variant, FIG. 5 shows, in a block circuit diagram, the control system associated with the gearbox elements according to FIG. 4, FIG. 6 shows, in a section, a detail of the gearbox elements which are connected to the development chamber of a second variant, FIG. 7 shows, in a block circuit diagram, the control system associated with the gearbox elements according to FIG. 6, and FIG. 8 shows, partly cut away, a detail of the gearbox elements connected to the development chamber of a third variant, connected to associated control elements which are represented as a block circuit diagram.

In all Figures, the same parts are designated by the same reference numbers.

In FIG. 1, a roll of diazo copying material is indicated by 1, from which roll diazo copying material is drawn off, in the form of a web, to a cutting device 3 and a measuring device 2 located in front of the cutting device. An exposure station with a holder 5 for the original copy and a pressure plate 6 follows in the direction of transport of the diazo copying material as shown by the arrow 4. The diazo copying material is exposed imagewise, via a condenser lens 8 and through the original copy, to a lamp 7, which is located below the transparent holder for the original copy, when a slot diaphragm 9 passes between the lamp and the condenser lens. Further in the direction of transport of the diazo copying material there follows a belt conveyor 10. A gripper arm 11 of a gripping device is so arranged that it can take an exposed sheet of diazo copying material from the exposure station and lay it on the belt conveyor 10. The belt conveyor transports the exposed sheet of copying material into the development chamber 12. The developed sheet of diazo copying material is delivered from the development chamber onto the stacker 13.

In FIG. 2 the horizontally arranged development chamber 12, which is essentially closed on all sides, is represented in more detail in a longitudinal section. From left to right the development chamber has a feed opening 14 and, next to it in the interior of the development chamber, a pair of feed rolls 15. A pair of guide rolls 16 is located next to the pair of feed rolls, and a second pair of guide rolls 17 is located, opposite to the first pair of guide rolls, at the opposite end of the development chamber. An endless belt 18 is fitted around the upper rolls of each pair of guide rolls, which pair of guide rolls has retaining flanges, which are not represented, for axially guiding the diazo copying material, and an endless belt 19, opposite the endless belt 18, around the rolls of the lower pair of rolls. The endless belts 18, 19, have a greater spacing in the vicinity of the pair of guide rolls 16 than in the vicinity of the pair of guide rolls 17. A free wedgeshaped space 22 for taking up the sheet of diazo copying material to be developed is thereby formed between the opposite sides 20, 21 of the two endless belts. The endless belts are composed of a single, closed web of gas-permeable screen-printing fabric. Next to the guide rolls 17 a pair of delivery rolls 23 is located, in front of a delivery opening 24, to close the development chamber. In addition, the sealing plates 40 to 43 lie close to the pair of feed rolls and the pair of delivery rolls in order to seal the development chamber. The entire transport device within the development chamber is symmetrical about the transport plane 25 drawn with a broken line.

It can be further seen in FIG. 2 how the suction lines 26 are provided bordering onto the feed opening 14, and suction lines 27 bordering onto the delivery opening 24. The suction lines are connected to a suction device which has an ammonia absorption installation, which is not represented in the drawing. A vaporizer, which comprises essentially a trough 28, an anti-splash baffle 29 located at a distance above it and an instilling tube 30 for the developer fluid, is located on the bottom of the development chamber. A heating means 31 is connected, so that it can conduct heat, to the bottom 34 of the development chamber and the trough 28. In addition a heating means 33 is provided on and in contact with the cover 32 of the development chamber, so that it can conduct heat. The heating means is connected at the exit of a temperature regulator 35. The measured value input of the temperature regulator 35 is connected to a temperature probe 37, and a desired-value setting device 39 is connected to the specified value input.

The development chamber is operated in such a manner that at a certain setting of the desired-value setting device 39 a temperature of about 80° C. prevails in the interior of the development chamber. A metered amount of aqueous ammonia, preferably with an ammonia content of 25% by weight, is fed into the instilling tube 30. The amount of aqueous ammonia is so metered that sufficient vaporized developer medium is formed to displace virtually all the air from the development chamber, and to compensate for the consumption of the development medium by leakage losses and by being carried out with the diazo copying material. The degassed water is drained away in a discharge tube, which is not represented. At another setting of the desired-value setting device 39 the temperature in the development chamber assumes values from 105° to 120° C. The aqueous ammonia is so metered that the gaseous developer medium in the development chamber remains unsaturated. The sheet of diazo copying material is transported through the developer chamber with a dwell time such that it is very well developed at each setting of the temperature desired-value setting device, but does not remain longer in the development chamber than is necessary for this purpose. In particular, for development at an elevated temperature the diazo copying material is transported through the development chamber at a speed of about 4 m/minute. On the other hand, at a setting of a development temperature at a lower value of about 80° C., the mean transport speed is reduced to about 2 m/minute. The latter can be effected by the diazo copying material being transported through the development chamber at a uniform speed of this value or in that the diazo copying material is fed into the development chamber at the normal relatively high transport speed but is not, however, transported continuously therein at this speed but remains for a preset standstill time, so that altogether the mean transport speed corresponding to the length of the development chamber divided by the dwell time (standstill time plus transport time) gives the desired mean transport speed. The transport of the diazo copying material at a speed which is reduced compared with the transport speed of the whole microfiche duplicating machine presupposes, as mentioned, that the sheets of diazo copying material or microfiches are transported into the development chamber with a spacing in time and distance.

FIG. 3 illustrates how a drive element is connected to the driven elements of the microfiche duplicating machine with the development chamber. In FIG. 3 a drive chain wheel indicated by 44 is connected to a drive motor 36. A primary chain 45 connects the drive chain wheel to the chain wheel 46*a, b,* which serves as a twin chain wheel on the one hand for driving the belt conveyor 10 and for driving a secondary chain 47. The secondary chain is passed around a chain wheel 48 for actuating the pressure plate 6, around a tensioning wheel 49, a chain wheel 50 which is connected to a coupling for actuating the cutting device 3, a chain wheel 51 for transporting the diazo copying material from the roll 1 of diazo copying material, and chain wheels 52, 53 for actuating the slot diaphragm, between which wheels a further guide wheel 54 is located.

The drive of the transport members of the development chamber is effected via a pair of cogs 55*a, b,* in which operation the cog 55*a* is frictionally connected to the twin chain wheel 46*a, b* and the cog 55*b* rests on an intermediate shaft which carries a pinion 58 for a second secondary chain 56. This secondary chain 56 is passed around the chain wheels 57*a, b* on the pair of feed rolls, around the guide wheels 59, 60 and around the chain wheels 61*a, b* on the pair of delivery rolls.

In FIG. 4 is shown more accurately, in a variant, how the drive of the endless belts in the development chamber is effected. Accordingly, the chain wheel 57*b* and in addition a double cog with two gear rings 62, 63, are mounted on a journal 64 of the lower feed roll, in a groove and tongue joint.

The gear rings 62, 63 mesh in the gear rings of the cogs 65, 66, which are mounted, so that they can turn independently of each other but cannot move axially, on a journal 67 of the lower guide roll of the pair of guide rolls 16. The cog 65 or the cog 66 can be frictionally connected to the journal, each by a magnetic clutch 68 and 69. The magnetic clutch 68 is composed of an electromagnet 69*a* attached firmly to the machine, a clutch disc 70 keyed to the journal 67, and a clutch facing 71 which is ferromagnetic, or is connected to a ferromagnetic element, and is arranged so that it can be moved elastically in the axial direction in the side of the cog 65. The magnetic clutch 69 comprises, analogously with the above, a stationary electromagnet 72, a clutch disc 73, and an elastically mounted clutch facing 74. The gear ratios between the cogs 65 and 66, on the one hand, and the double cog 62 and 63, are so chosen that the peripheral speed of the feed roll 15 is equal to the circulation speed of the endless belt 21, when the cog 65 is coupled to the journal 67, and that the circulation speed of the endless belt 21 is less than the peripheral speed of the feed roll 15 when the cog 66 is frictionally connected to the journal 67.

In FIG. 5 a control system is represented with which the gearbox elements in FIG. 4 are actuated. From this it can be seen that the desired-value setting device 39 is connected to the specified value input of the temperature regulator 35, which desired-value setting device is connected in series with a series resistor 75 in a design which is most simple.

In addition, the temperature probe connected to the measured value input, and the heating means 31, 33, connected to the output of the temperature regulator, can be distinguished. Furthermore a current supply unit 76 can be seen in FIG. 5, which can be switched through, as desired, by means of a change-over switch 77, to one of the two magnetic clutches 68, 69. A closing contact 78 which is in parallel with the series resistor 75 is coupled to the change-over switch 77.

This control system operates, in connection with the gearbox elements according to FIG. 4, in the following manner. In the switching position drawn, the series resistor 75 is not shunted, so that the specified value of the temperature regulator 35 is set at a relatively low value. Accordingly, the interior of the development chamber is heated only to a low temperature. In this case the magnetic clutch 69 is connected to the current supply unit. The force transmission for the drive of the guide roll 16, represented in FIG. 4, passes from the chain wheel 57*b* via the gear ring 62 of the double cog 62, 63, to the cog 66 which is frictionally connected, via the magnetic clutch 69, to the journal 67. Accordingly the continuous transport speed of the endless belt 21 is relatively low and is matched to the slow development rate of the diazo copying material transported into the development chamber.

In the mechanically particularly simple variant of the drive of the guide roll 16 in FIG. 6, the chain wheel 57*b* on the journal 64 is frictionally connected to the spur gear 79 which meshes with a spur gear 80 of the same diameter. The spur gear 80 can be frictionally connected to the journal 67 by means of a magnetic clutch 81 which is constructed in the same way as the magnetic clutches 68, 69. FIG. 7 shows the associated control system:

The arrangement of the temperature regulator 35, of the heating means 31, 33 connected to it, of the temperature probe 37, and of the desired-value setting device with the series resistor 75, is identical with that according to FIG. 5. Peculiar to the control system according to FIG. 7 is a timer 82 provided to give a standstill time which can be preset with the setting of the setting member 83. The timer can be switched on by means of a switch 84 which is coupled to the closing contact 78. In addition a sensing member 85 is connected to the input side of the timer, which sensing member is so arranged on the transport plane 25 in FIG. 2, that a signal indicates when the sheet of copying material lies completely on the lower endless belt 21. This can be effected by detecting the rear edge of the sheet of copying material in the vicinity of the feed rolls. The control system according to FIG. 7 operates in connection with the gearbox elements in FIG. 6, in the following manner:

In the drawn position of the closing contact 78 the temperature within the development chamber is set at a relatively low value. In this case the switch 84 is closed onto the timer. When a sheet of copying material has entered the interior of the development chamber so that it lies completely on the lower endless belt 21, the sensing member, which detects the rear edge of this sheet of copying material, gives a signal, whereupon the timer opens the closing contact 86 which is actuated by the output of the timer and which is located in the current supply line of the magnetic clutch 81. After a dwell time which is preset by the setting member 83, the opened closing contact 86 is closed again and the sheet of diazo copying material located in the development chamber is conveyed by the movement of the endless belts 21 to the pair of delivery rolls 23 and carried by these out of the development chamber. The standstill time is set with the setting element 83 so that the total dwell time, which is given by the standstill time plus the transport time of the sheet of diazo copying material through the development chamber, is sufficient to completely develop the diazo copying material even at the lower temperature of the development medium. If, on the other hand, the closing contact 78 on the specified value input is closed, a higher temperature is set in the development chamber and the sheet of diazo copying material can be transported continuously through the development chamber at a transport speed corresponding to the peripheral speed of the pair of feed rolls 15. For this purpose the switch 84 on the timer is opened so that the timer does not operate, and the closing contact 86 in the current supply line of the magnetic clutch 81 is closed all the time.

The variant, shown in FIG. 8, of the arrangement of the gearbox elements on the development chamber differs from that according to FIG. 6 in that an infinitely variable gearbox 90 is provided in place of the pair of spur gears 79, 80. A step motor 91, which is connected to a control device 92, serves for setting the gear ratio of the infinitely variable gearbox. The gear ratio of the infinitely variable gearbox can be preset by a speed setter 93.

The transport speed of a sheet of diazo copying material to be transported through the development chamber can be influenced with the arrangement, according to FIG. 8, in two ways. In one way it is possible, by means of the setting of the speed setter, to set the gear ratio of the infinitely variable gearbox 90 to such a value that the peripheral speed of the feed roll 15 is the same as the circulation speed of the endless belt 21. This setting is chosen when the diazo copying material is to be developed at a relatively high temperature of the development medium. If, however, the development medium is at a relatively low temperature, the setting of the speed setter 93 is changed in such a way that the gear ratio of the infinitely variable gearbox 90 is set to the slower drive of the endless belt 21. For changing the setting of the speed setter 93, the latter is appropriately coupled to the reference element of the temperature regulator.

While in the mode of operation described above the diazo copying material in both operating cases—relatively high temperature and relatively low temperature—is transported continuously through the development chamber, it is also possible, with the variant according to FIG. 8, to vary the resultant dwell time of the diazo copying material by intermittent transport with a preset standstill time. In this case the infinitely variable gearbox 90 is preferably set, with the speed setter 93, to such a value that for development at a relatively low temperature the transport through the development chamber can be effected discontinuously. In this process it is possible, depending on the setting of the development temperature, to vary the circulation speed of the endless belt 21 relative to the peripheral speed of the feed roll 15 by appropriate adjustment of the speed setter 93. The control of the drive of the endless belt 21, during development at a relatively high temperature, is effected by the magnetic clutch 81 which is provided in a circuit arrangement according to FIG. 7.

Finally, it is possible, with the variants of the arrangement of the gearbox elements according to FIGS. 4 and 8, to change the effective transport speed of the diazo copying material through the development chamber by a combination of a change of the gear ratio and by a presetting of standstill times in individual operating cases. In this manner it is also possible to adapt the effective transport speed of the diazo copying material to not only two development conditions in the development chamber but to a plurality of such conditions, in particular different temperatures.

It will be obvious to those skilled in the art that many modifications may be made within the scope of the present invention without departing from the spirit thereof, and the invention includes all such modifications.

What is claimed is:

1. A development device for developing sheets of diazo copying material, at a lower and a higher development temperature, in particular microfiches, comprising a substantially gas-tight, closed development chamber adapted to contain a developer medium composed of ammonia gas and water vapor, a pair of feed rolls at a feed opening, a pair of delivery rolls at a delivery opening and a first and a second pair of guide rolls in said chamber next to the pair of feed rolls and the pair of delivery rolls, an upper and a lower gas-permeable endless belt guided around one roll of each pair of guide rolls in each case, a space between adjacent sides of said upper and lower endless belts aligned with gaps between the pairs of feed and delivery rolls, said space between the upper and lower endless belts being greater at the side facing the pair of feed rolls than at the side facing the pair of delivery rolls whereby the space between the adjacent sides is wedge-shaped, means for presetting the peripheral speed of the feed rolls independently of the development temperature, and means to set, at a higher development temperature, the circulation speed of the endless belts at a circulation speed equal to the peripheral speed of the pair of said feed rolls, and to reset, at a lower development temperature, the circulation speed of the endless belts to a speed lower than the peripheral speed of the pair of feed rolls.

2. A development device according to claim 1 including an electromagnetically operable clutch means which connects a pair of guide rolls to a drive motor, means connecting the electromagnetically operable clutch to a timer for presetting a standstill time, and means connecting the input of the timer to a pulse generator which gives a pulse when each sheet of diazo copying material has entered the development chamber.

3. A development device according to claim 1 including at least one heating means for heating the development chamber and at least one thermostat with a desired-value setting device for regulating the temperature in the development chamber, means connecting the thermostat to the heating means, and means coupling actuating means for the gearbox to the desired-value setting device with a series resistor of the thermostat.

4. A development device according to claim 2 including at least one heating means for heating the development chamber and at least one thermostat, connected to the heating means, with a desired-value setting device for regulating the temperature in the development chamber, means whereby the timer is set up to give adjustable time intervals, and means coupling a setting element of the timer to a desired-value setting device in order to preset the time intervals.

5. A development device according to claim 2 including an exposure station connected with the development chamber and further stations for cutting a sheet of diazo copying material from a supply roll, for transporting the sheet of diazo copying material to the exposure station and for transporting the imagewise exposed sheet of diazo copying material to the development chamber, a shared drive motor for driving these stations, and means connecting at least the one pair of guide rolls via a gearbox and the clutch, to the drive motor.

* * * * *